United States Patent [19]

Stewart

[11] 4,231,753

[45] Nov. 4, 1980

[54] CONTROL OF A CRACKING FURNACE

[75] Inventor: William S. Stewart, Bartlesville, Okla.

[73] Assignee: Phillips Petroleum Company, Bartlesville, Okla.

[21] Appl. No.: 22,909

[22] Filed: Mar. 22, 1979

[51] Int. Cl.[2] ..... G06G 7/58; G06F 15/18

[52] U.S. Cl. ..... 23/230 A; 422/62; 422/119; 422/110; 422/109; 364/500

[58] Field of Search ..... 23/230 A; 422/62, 119, 422/110, 109; 364/500, 501; 260/683

[56] References Cited

U.S. PATENT DOCUMENTS

| | | | |
|---|---|---|---|
| 3,271,472 | 9/1966 | Ogle et al. | 260/683 |
| 3,353,920 | 11/1967 | Kitzen . | |
| 3,824,388 | 7/1974 | Cugini | 260/683 |
| 4,094,959 | 6/1978 | Ball et al. | 23/230 A |
| 4,115,862 | 9/1978 | Stewart | 23/230 A |

*Primary Examiner*—R. E. Serwin

[57] ABSTRACT

The heat supplied to a cracking furnace is controlled in response to a calculation of the heat required to maintain a desired conversion rate for the material being cracked in the cracking furnace. The calculated required heat for the cracking furnace is corrected by a comparison of the actual conversion rate to a desired conversion rate. The corrected required heat signal is utilized to manipulate the flow of fuel to the cracking furnace to thereby control the heat supplied to the cracking furnace.

The flow of steam to the cracking furnace is also manipulated so as to prevent damage to the cracking furnace caused by a loss of feed flow to the cracking furnace. A loss in the flow of the feed to the cracking furnace is detected and the flow of the steam is increased to compensate for the loss in the flow of the feed to the cracking furnace so as to prevent damage to the cracking tubes of the cracking furnace.

47 Claims, 2 Drawing Figures

CONTROL OF A CRACKING FURNACE

Figure 1:
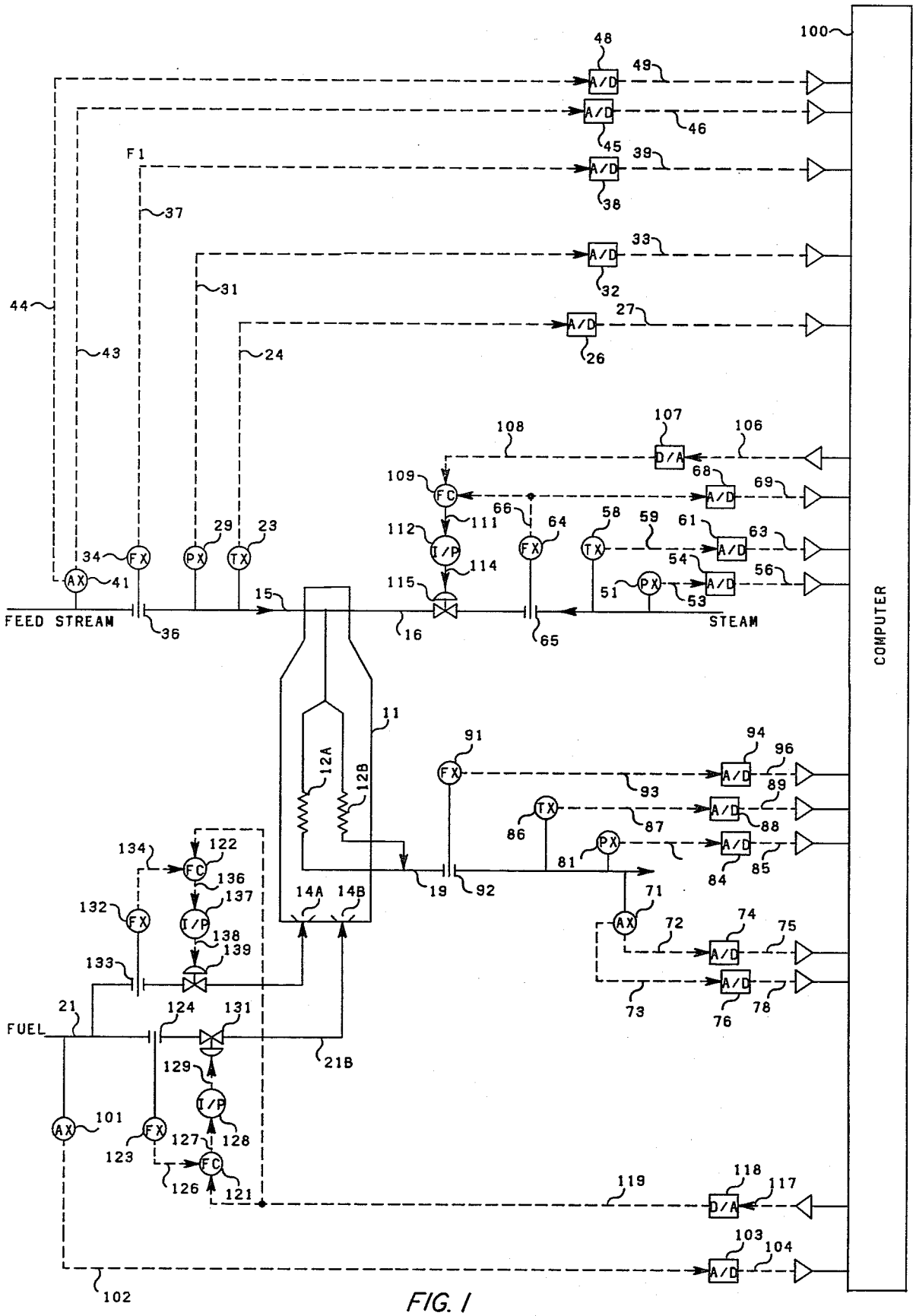

This invention relates to control of a cracking furnace. In a particular aspect this invention relates to method and apparatus for controlling the fuel supply to a cracking furnace so as to maintain a desired conversion rate for a material being cracked. In another particular aspect this invention relates to method and apparatus for controlling the flow of steam to a cracking furnace so as to prevent damage to the cracking furnace caused by a loss of feed flow to the cracking furnace.

The cracking furnace forms the heart of many chemical manufacturing processes. Often the performance of the cracking furnace will carry the burden of the major profit potential for the entire manufacturing process. Close control of the cracking furnace is required to both maintain a desired conversion rate in the cracking furnace and to prevent damage to the cracking furnace.

In a manufacturing process such as the manufacture of ethylene, natural gas such as ethane and/or propane is fed into the cracking furnace. Within the furnace the feed gas is converted to a gaseous mixture which primarily contains hydrogen, methane, ethylene, propylene, butadiene and small amounts of heavier gases. At the furnace exit this mixture is cooled, which allows removal of most of the heavier gases, and compressed.

The compressed mixture is routed through various distillation columns where the individual components such as ethylene are purified and separated. The separated products, of which ethylene is the major product, then leave the ethylene plant to be used in numerous other processes for the manufacture of a wide variety of secondary products.

The primary function of the cracking furnace is to convert the natural gas to ethylene and/or propylene. The temperature of the cracking furnace determines the percentage of the ethane that will be converted to ethylene or the percentage of the propane that will be converted to propylene. The desired percentage conversion for ethane to ethylene or propane to propylene is usually specified for a manufacturing process and the fuel supplied to the cracking furnace is controlled so as to maintain the required temperature necessary to maintain the desired percentage conversion. The temperature of the gaseous mixture flowing from the cracking furnace exit or an analysis of the gaseous mixture flowing from the cracking furnace exit is commonly utilized to provide a means for controlling the fuel supplied to the cracking furnace. The measured parameters are compared to desired parameters and the resulting comparison is utilized to control the flow of fuel to the cracking furnace. This type of control is commonly referred to as feedback control.

If only feedback control is utilized, no change in the flow rate of fuel to the cracking furnace is made until a process change is reflected in the gaseous mixture flowing from the outlet of the cracking furnace. For example, if the flow rate of the natural gas to the cracking furnace is decreased, the heat required to maintain a desired percent conversion is also decreased. However, if only the changes in the gaseous mixture flowing from the outlet of the cracking furnace are monitored, then the heat supplied to the cracking furnace will not be changed as a function of the change in the flow rate of the natural gas to the cracking furnace. This results in the actual percentage conversion deviating from the desired percentage conversion until such time as the change in the analysis of the gaseous mixture flowing from the cracking furnace indicates that the heat supplied to the cracking furnace should be reduced. This may result in long periods of off-specification operation if the flow rate of the natural gas to the cracking furnace is varying or if other variables are not constant.

Feedforward control, which is sometimes termed predictive control, provides a method by which closer control of a cracking furnace can be obtained. In feedforward control measurements of disturbances are used to provide a prediction of any change in the flow rate of fuel to the cracking furnace which is necessary to compensate for any changes in the measured process variables so that on-specification operation can be maintained. Predictive or feedforward control provides a faster control response the changes in process variables. Feedback control is utilized to correct the feedforward control signals as necessary.

It is thus an object of this invention to provide method and apparatus for controlling the fuel supplied to a cracking furnace so as to maintain the desired conversion rate for a material being cracked. It is a particular object of this invention to provide method and apparatus for utilizing measurements of disturbances to provide feedforward control for the flow rate of the fuel being supplied to the cracking furnace and utilizing a comparison of the desired conversion rate for the material being cracked with the actual conversion rate to provide feedback control of the flow rate of the fuel flowing to the cracking furnace.

Steam is usually combined with the feed material being provided to the cracking furnace as a diluent. The flow of the steam is controlled so as to maintain a desired rate of feed gas to steam. Thus, if the flow of the feed gas decreases, the flow of the steam will also decrease. If the flow of the feed gas to the cracking furnace is disrupted or stopped unexpectedly, many prior control systems operated to also shut off the flow of the steam. This would result in overheating and damage to the cracking tubes of the cracking furnace.

It is thus an object of this invention to provide method and apparatus for controlling the flow of steam to a cracking furnace so as to prevent damage to the cracking furnace caused by a loss of feed flow to the cracking furnace. It is a further object of this invention to provide method and apparatus for maintaining the flow of steam to a cracking furnace at some minimum level which will prevent damage to the cracking furnace even if the feed flow to the cracking furnace is totally disrupted.

In accordance with the present invention, method and apparatus is provided whereby measurements of the flow rates of the feed material and the steam being provided to the cracking furnace and an analysis of the feed material being provided to the cracking furnace is utilized to provide a prediction of the heat required in the cracking furnace to maintain a desired percent conversion. The prediction of the heat required in the cracking furnace is corrected as necessary by a comparison of the desired percent conversion with the actual percent conversion. The corrected prediction of the required heat for the cracking furnace is utilized to manipulate the flow of fuel to the cracking furnace to thereby maintain the percent conversion in the cracking furnace at a desired level.

The flow rate of the feed material flowing to the cracking furnace is also monitored to provide a means for controlling the ratio of the feed material and steam provided to the cracking furnace. The flow rate of the steam to the cracking furnace is controlled directly in response to the flow rate of the feed material to the cracking furnace but the flow rate of the steam is not allowed to drop below a minimum level which would prevent damage to the cracking furnace caused by overheating even if the flow of the feed material to the cracking furnace is totally disrupted. In this manner a required feed material to steam ratio is maintained while still providing protection to the cracking furnace if the flow of feed material to the cracking furnace is totally disrupted.

Figure 2:
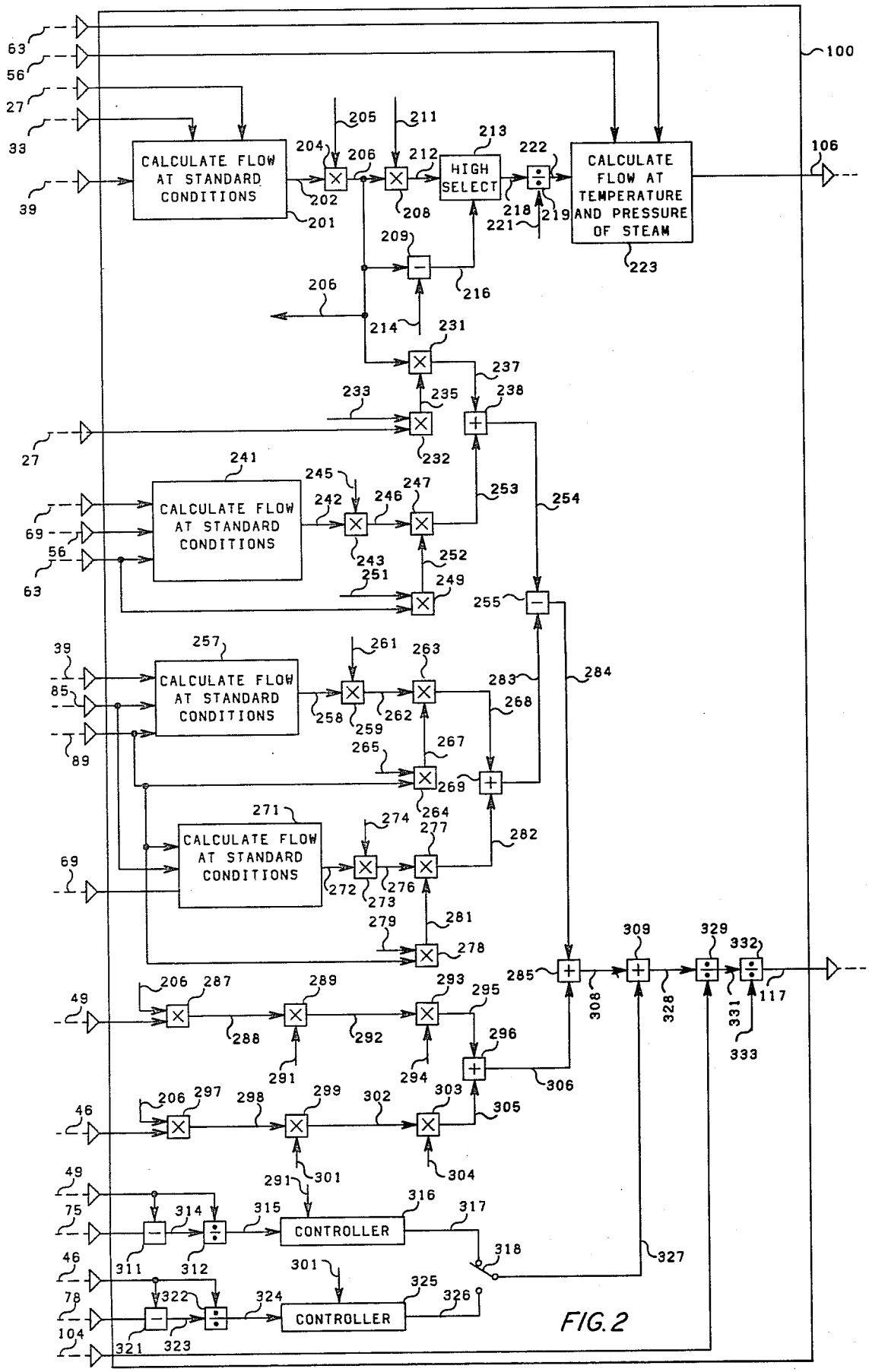

Other objects and advantages of the invention will be apparent from the description of the invention and the appended claims as well as from the detailed description of the drawings in which:

FIG. 1 is a schematic diagram of a cracking furnace with an associated control system; and FIG. 2 is a logic diagram for the computer logic utilized to generate the control signals utilized in the control of the cracking furnace illustrated in FIG. 1.

For the sake of simplicity the invention is illustrated and described in terms of a single cracking furnace having only two burners and heating sections. However, the invention is also applicable to multiple furnaces and is applicable to furnaces having only one burner and heating section or a plurality of burners and heating sections.

The invention is also illustrated and described in terms of a process for the manufacture of ethylene. However, the applicability of the invention described herein extends to other processes wherein a cracking furnace is utilized to crack a feed into some desired components. A specific control configuration is set forth in FIG. 1 for the sake of illustration. However, the invention extends to different types of control system configurations which accomplish the purpose of the invention. Lines designated as signal lines in the drawings are electrical in this preferred embodiment. However, the invention is also applicable to pneumatic, mechanical, hydraulic or other signal means for transmitting information. In almost all control systems some combination of these types of signals will be used. However, use of any other type of signal transmission, compatible with the process and equipment in use, is within the scope of the invention.

Controllers shown may utilize the various modes of control such as proportional, proportional-integral, proportional-derivative, or proportional-integral-derivative. In this preferred embodiment, proportional-integral controllers are utilized. The operation of these types of controllers is well known in the art. The output control signal of a proportional-integral controller may be represented as $$S=K_1E+K_2\int E\,dt$$

where

S=output control signals;

E=difference between two input signals; and $K_1$ and $K_2$=constants.

The various transducing means used to measure parameters which characterize the process and the various signals generated thereby may take a variety of forms or formats. For example, the control elements of the system can be implemented utilizing electrical analog, digital electronic, pneumatic, hydraulic, mechanical or other similar types of equipment or combinations of one or more such equipment types. While the presently preferred embodiment of the invention preferably utilizes a combination of pneumatic control elements, electrical analog signal handling and translation apparatus, and a digital computer, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other measuring instruments may produce a signal which bears a more complicated, but known, relationship to the measured parameter. In addition, all signals could be translated into a "suppressed zero" or other similar format in order to provide a "live zero" and prevent an equipment failure from being erroneously interpreted as a low (or high) measurement or control signal. Regardless of the signal format or the exact relationship of the signal to the parameter which it represents, each signal representative of a measured process parameter are representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1, a conventional cracking furnace 11 is illustrated having two cracking tubes 12*a* and 12*b*. Heat is supplied to the two cracking tubes 12*a* and 12*b* by means of burners 14*a* and 14*b* respectively. As has been previously stated, the cracking furnace 11 is illustrated as having only two burners and two cracking tubes for the sake of convenience. Ordinarily a cracking furnace used in a process such as the manufacture of ethylene will have a larger number of cracking tubes and burners. Also in a process such as the manufacture of ethylene a plurality of cracking furnaces will commonly be utilized.

A hydrocarbon such as ethane and/or propane is provided as a feed gas to the cracking furnace 11 through conduit means 15. Steam is provided to the cracking furnace 11 through conduit means 16. The feed steam flowing through conduit means 15 and the steam flowing through conduit means 16 are combined within the cracking furnace 11 and flow through the cracking tubes 12*a* and 12*b*. After passing through the cracking tubes 12*a* and 12*b* in which the feed gas is converted to ethylene, propylene and other gases, the gaseous mixture is combined and flows to various distillation columns through conduit means 19.

Fuel is supplied to the cracking furnace 11 through conduit means 21. Specifically fuel is supplied to burner 14*a* through conduit means 21*a* which is operably connected to conduit means 21. Fuel is supplied to burner 14*b* through conduit means 21*b* which is also operably connected to conduit means 21.

Temperature transducer 23 provides a signal 24 which is representative of the temperature of the natural gas flowing through conduit means 15. Signal 24 is provided from the temperature transducer 23 to the analog-to-digital (A/D) converter 26. The A/D converter 26 converts signal 24 to digital form and provides signal 27, representative of the temperature of the natural gas flowing through conduit means 15, to computer means 100. The pressure transducer 29 provides a signal 31 representative of the pressure of the natural gas flowing through conduit means 15. Signal 31 is provided from the pressure transducer 29 to the A/D converter 32. The A/D converter 32 converts signal 31 to digital form and provides a signal 33, representative of the pressure of the natural gas flowing through conduit means 15, to computer means 100. Flow transducer 34 in combination with flow sensor 36, which is operably located in conduit means 15, provides an output signal 37 which is representative of the volume flow rate of the natural gas flowing through conduit means 15. Signal 37 is provided from the flow transducer 34 to the A/D converter 38. The A/D converter 38 converts signal 37 to digital form and provides signal 39, representative of the volume flow rate of the natural gas flowing through conduit means 15 to computer means 100. Analyzer transducer 41, which is preferably a chromatographic analyzer, provides a pair of output signals 43 and 44. Signal 43, which is representative of the concentration of propane in the natural gas flowing through conduit means 15, is provided from the analyzer transducer 41 to the A/D converter 45. Signal 43 is converted to digital form by the A/D converter 45 and is provided as signal 46 to the computer means 100. Signal 44, which is representative of the concentration of ethane in the natural gas flowing through conduit means 15, is provided from the analyzer transducer 41 to the A/D converter 48. Signal 44 is converted to digital form by the A/D converter 48 and is provided as signal 49 to computer means 100.

Pressure transducer 51 provides an output signal 53 representative of the pressure of the steam flowing through conduit means 16. Signal 53 is provided from the pressure transducer 51 to the A/D converter 54. Signal 53 is converted to digital form by the A/D converter 54 and is provided as signal 56 to computer means 100. The temperature transducer 58 provides an output signal 59 representative of the temperature of the steam flowing through conduit means 16. Signal 59 is provided from the temperature transducer 58 to the A/D converter 61. Signal 59 is converted to digital form by the A/D converter 61 and is provided as signal 63 to the computer means 100. The flow transducer 64 in combination with the flow sensor 65, which is operably located in conduit means 16, provides an output signal 66 which is representative of the flow rate of the steam flowing through conduit means 16. Signal 66 is provided to the A/D converter 68 from the flow transducer 64. Signal 66 is converted to digital form by the A/D converter 68 and is provided as signal 69 to the computer means 100.

Analyzer transducer 71, which is preferably a chromatographic analyzer, provides a pair of output signals 72 and 73. Signal 72, which is representative of the concentration of ethylene in the gaseous mixture flowing through conduit means 19, is provided to the A/D converter 74. Signal 72 is converted to digital form by the A/D converter 74 and is provided as signal 75 to the computer means 100. Signal 73, which is representative of the concentration of propane in the gaseous mixture flowing through conduit means 19, is provided from the analyzer transducer 71 to the A/D converter 76. Signal 73 is converted to digital form by the A/D converter 76 and is provided as signal 78 to the computer means 100. Pressure transducer 81 provides an output signal 82 which is representative of the pressure of the gaseous mixture flowing through conduit means 19. Signal 82 is provided from the pressure transducer 81 to the A/D converter 84. Signal 82 is converted to digital form by the A/D converter 84 and is provided as signal 85 to computer means 100. The temperature transducer 86 provides an output signal 87 which is representative of the temperature of the gaseous mixture flowing through conduit means 19. Signal 87 is provided from the temperature transducer 86 as an input to the A/D converter 88. Signal 87 is converted to digital form by the A/D converter 88 and is provided as signal 89 to computer means 100. The flow transducer 91 in combination with the flow sensor 92, which is operably located in conduit means 19, provides an output signal 93 which is representative of the volume flow rate of the gaseous mixture flowing through conduit means 19. Signal 93 is provided from the flow transducer 91 to the A/D converter 94. Signal 93 is converted to digital form by the A/D converter 94 and is provided as signal 96 to computer means 100.

Analyzer transducer 101, which is preferably a chromatographic analyzer, provides an output signal 102 which is representative of the BTU content of the fuel flowing through conduit means 21. Signal 102 is provided from the analyzer transducer 101 to the A/D converter 103. Signal 102 is converted to digital form by the A/D converter 103 and is provided as signal 104 to the computer means 100.

In response to the described input signals, the computer means 100 generates a pair of control signals which are utilized to control the cracking furnace 11. Signal 106, which is representative of the required volume flow rate of the steam flowing through conduit means 16, is provided from computer means 100 to the digital-to-analog (D/A) converter 107. Signal 106 is converted to analog form by the D/A converter 107 and is provided as signal 108 to the flow controller 109. The flow controller 109 is also provided with signal 66, representative of the actual volume flow rate of the steam flowing through conduit means 16, from the flow transducer 64. The flow controller 109 compares signal 66 and signal 108 and outputs a signal 111 which is responsive to the difference between signal 66 and signal 108. Signal 111 is converted to pneumatic form by the current-to-pneumatic transducer 112 and is provided as signal 114 to the pneumatic control valve 115. The pneumatic control valve 115 is operably located in conduit means 16. The pneumatic control valve 115 is manipulated in response to signal 114 to thereby control the flow of steam through conduit means 16 to provide a desired ratio of steam to natural gas and to also protect the cracking tubes **12*a* and 12*b***.

Signal 117, which is representative of the required volume flow rate for the fuel flowing through conduit means **21*a* and 21*b*, is provided from the computer means 100 to the D/A converter 118. Signal 117 is converted to analog form by the D/A converter 118 and is provided as signal 119 to flow controllers 121 and 122. Flow transducer 123 in combination with flow sensor 124, which is operably located in conduit means 21*b*, provides an output signal 126 which is representative of the actual volume flow rate of the fuel flowing through conduit means 21b. Signal 126 is provided from the flow transducer 123 to the flow controller 121. The flow controller 121 compares signal 126 to signal 119 and outputs a signal 127 responsive to the difference between signal 126 and signal 119. Signal 127 is converted to pneumatic form by the current-to-pressure transducer 128 and is provided as signal 129 to the pneumatic control valve 131. The pneumatic control valve 131 is operably located in conduit means 21b. The pneumatic control valve 131 is manipulated in reponse to signal 129 to thereby control the flow of the fuel through conduit means 21b to the burner 14b**.

Flow transducer 132 in combination with flow sensor 133, which is operably located in conduit means 21a, provides an output signal 134 which is representative of the actual volume flow rate of the fuel flowing through conduit means 21a. Signal 134 is provided from the flow transducer 132 to the flow controller 122. The flow controller 122 compares signal 134 to signal 119 and provides an output signal 136 responsive to the difference between signal 134 and signal 119. Signal 136 is converted to pneumatic form by the current-to-pressure transducer 137 and is provided as signal 138 to the pneumatic control valve 139. The pneumatic control valve 139 is operably located in conduit means 21a. The pneumatic control valve 139 is manipulated in response to signal 138 to thereby control the flow of fuel through conduit means 21a to the burner 14a.

The following development of the control signals 106 and 117, illustrated in FIG. 1, is provided to clarify the logic flow diagram illustrated in FIG. 2. The required flow rate of fuel to the cracking furnace 11, illustrated in FIG. 1, is a function of the heat required by the cracking process. If the desired conversion of ethane and/or propane is known, then the heat required by the cracking process may be determined by a heat balance for the process. For the cracking furnace illustrated in FIG. 1 a heat balance is given by $$Q = H_{IN} - H_{OUT} + H_{CE} + H_{CP} - H_L \quad \text{(I)}$$

where $Q$ = heat that must be supplied to the cracking furnace by the fuel;

$H_{IN}$ = heat supplied to the cracking furnace by the feed gas and the steam;

$H_{OUT}$ = heat removed from the cracking furnace by the gaseous mixture flowing from the cracking furnace;

$H_{CE}$ = heat supplied to the cracking furnace by the conversion of ethane;

$H_{CP}$ = heat supplied to the cracking furnace by the conversion of propane; and $H_L$ = heat lost to atmosphere and other miscellaneous heat loss terms.

The heat supplied to the cracking furnace by the feed gas and the steam is given by $$H_{IN} = (F_{HI})(C_{PH})(T_{HI}) + (F_{SI})(C_{PS})(T_{SI}) \quad \text{(II)}$$

where $F_{HI}$ = mass flow rate of the hydrocarbon feed stream flowing into the cracking furnace;

$C_{PH}$ = specific heat of the hydrocarbon feed stream flowing into the cracking furnace;

$T_{HI}$ = temperature of the hydrocarbon feed stream flowing into the cracking furnace;

$F_{SI}$ = mass flow rate of the steam flowing into the cracking furnace;

$C_{PS}$ = specific heat of the steam flowing into the cracking furnace; and $T_{SI}$ = temperature of the steam flowing into the cracking furnace.

The heat removed from the cracking furnace by the gaseous mixture flowing from the cracking furnace is given by $$H_{OUT} = (F_{HO})(C_{PH})(T_O) + (F_{SO})(C_{PS})(T_O) \quad \text{(III)}$$

where $T_O$ = the temperature of the gaseous mixture flowing from the cracking furnace;

$F_{HO}$ = mass flow rate of the portion of the gaseous mixture flowing through conduit means 19 which is contributed by the feed stream flowing through conduit means 15;

$F_{SO}$ = mass flow rate of the portion of the gaseous mixture flowing through conduit means 19 which is contributed by the steam flowing through conduit means 16; and $C_{PH}$ and $C_{PS}$ are as previously defined.

It is noted that the mass flow rate of the feed stream into the cracking furnace is essentially equal to the mass flow rate of the part of the gaseous mixture flowing out of the cracking furnace which is made up of the cracked components of the feed stream. Also the mass flow rate of the steam into the cracking furnace is essentially equal to the mass flow rate of the steam in the gaseous mixture flowing out of the cracking furnace. Because of this, the measured volume flow rates for the hydrocarbon feed stream and the steam flowing into the cracking furnace may be utilized to calculate the heat being removed from the cracking furnace in the gaseous feed stream flowing from the cracking furnace. Also the specific heat of the feed stream and the specific heat of the steam are constants.

The heat supplied to the cracking furnace by the conversion of ethane is given by $$H_{CE} = (F_{HI})(C_E)(\mathrm{CONV}_E)(H_E) \quad \text{(IV)}$$

where $C_E$ = the concentration of ethane in the hydrocarbon feed flowing to the cracking furnace;

$\mathrm{CONV}_E$ = the desired percent conversion of ethane;

$H_E$ = the heat of reaction of ethane; and $F_{HI}$ is as previously defined.

The heat supplied to the cracking furnace by the conversion of propane is given by $$H_{CP} = (F_{HI})(C_P)(\mathrm{CONV}_P)(H_P) \quad \text{(V)}$$

where $C_P$ = concentration of propane in the hydrocarbon feed flowing to the cracking furnace;

$\mathrm{CONV}_P$ = the desired percent concentration of propane;

$H_P$ = heat of reaction for the conversion of propane; and $F_{HI}$ is as previously defined.

The heat loss to the atmosphere and other miscellaneous heat loss terms cannot be accurately measured. This term is supplied in the present invention by comparing the actual conversion of ethane or propane to the desired conversion of the ethane or propane. The difference between the desired and the actual conversion is utilized to supply the heat loss term in what could be termed feedback control of the cracking furnace.

The logic flow diagram utilized to calculate the control signals 106 and 117 in response to the previously described input signals to the computer means 100 is illustrated in FIG. 2. Symbols previously described and defined in the development of equations (I)-(V) are utilized in the description of FIG. 2. Referring now to FIG. 2, computer means 100 is shown as a solid heavy line surrounding the flow logic. Many of the measurement signals illustrated in FIG. 1 are utilized more than once in the computer logic illustrated in FIG. 2. However, the signals have been separated and the same number has been utilized to identify identical signals to avoid the confusion of numerous crossing lines.

Referring now to FIG. 2, signals 27, 33 and 39 which are representative of the measured temperature, measured pressure and the measured flow rate, respectively, of the feed stream flowing through conduit means 15 are supplied to block 201 of the illustrated flow diagram. Signals 27, 33 and 39 are utilized to calculate the volume flow rate of the feed stream flowing through conduit means 15 at standard conditions utilizing the equation $$F_{STP} = (F_{MEAS})\left(\sqrt{\frac{T_{STP}}{T_{MEAS}}}\right)\left(\sqrt{\frac{P_{MEAS}}{P_{STD}}}\right) \quad \text{(VI)}$$

where $F_{STP}$=volumetric flow rate at standard conditions;
$F_{MEAS}$=measured volumetric flow rate;
$T_{STD}$=standard temperature;
$T_{MEAS}$=measured temperature;
$P_{STD}$=standard pressure; and
$P_{MEAS}$=measured pressure.

Signal 202, which is representative of the volumetric flow rate of the hydrocarbon feed flowing through conduit means 15 at standard conditions is supplied as a first input to the multiplying block 204. The multiplying block 204 is also supplied with a second input signal 205 which is representative of the density of the feed stream flowing through conduit means 15. Signal 202 is multiplied by signal 205 to provide signal 206 which is representative of the mass flow rate of the hydrocarbon feed flowing through conduit means 15 ($F_{HI}$). Signal 206 is provided from the multiplying block 207 as a first input to the multiplying block 208, as a first input to the subtracting block 109, as a first input to the multiplying block 231, as a first input to the multiplying block 287 and as a first input to the multiplying block 197. The multiplying block 208 is provided with signal 211, representative of the desired steam to feed ratio, as a second input. Signal 206 is multiplied by signal 211 to provide signal 212 which is representative of the required mass flow rate of the steam necessary to maintain the desired steam to feed ratio represented by signal 211. Signal 212 is provided from the multiplying block 208 as a first input to the high select block 213.

The subtracting block 209 is provided with a signal 214 representative of the minimum total mass flow to the cracking tubes of the cracking furnace which will prevent damage by overheating of the cracking tubes. Signal 206 is subtracted from signal 214 in the subtracting block 209 to provide signal 216 which is representative of the minimum allowable mass flow rate of the steam flowing to the cracking furnace. Signal 216 is provided as a second input to the high select block 213 from the subtracting block 209.

The high select block 213 selects the higher of signals 212 or 216 and provides the higher signal as signal 218 to the dividing block 219. Signal 218 is thus representative of the required mass flow rate for the steam flowing to the cracking furnace through conduit means 16. Use of the minimum total flow set point 214 prevents severe disruptions in the flow rate of the feed stream to the cracking furnace from causing damage by overheating of the cracking tubes due to a reduced flow through the cracking tubes.

The dividing block 219 is provided with a signal 221, which is representative of the density of the steam flowing through conduit means 16, as a second input. Signal 218 is divided by signal 221 to provide signal 222 which is representative of the required volumetric flow rate of the steam flowing through conduit means 16 at standard conditions. Signal 222 is provided from the dividing block 221 to block 223. Block 223 is also provided with signal 56, which is representative of the measured pressure of the steam flowing through conduit means 16, and signal 63, which is representative of the measured temperature of the steam flowing through conduit means 16. The required volumetric flow rate of the steam at the temperature and pressure of the steam is calculated in block 223 utilizing a rearrangement of equation VI to provide the output signal 106 which is illustrated and described in FIG. 1.

Signal 27, which is representative of the temperature of the hydrocarbon feed flowing through conduit means 15 ($T_{HI}$), is provided as a first input to the multiplying block 232. The multiplying block 232 is provided with a second input signal 233 which is representative of the specific heat of the feed stream flowing through conduit means 15 ($C_{PH}$). Signal 233 is multiplied by signal 27 to provide signal 235 which is representative of the enthalpy of the feed stream flowing through conduit means 15 ($C_{PH}$) ($T_{HI}$). Signal 235 is provided as a second input to the multiplying block 231 from the multiplying block 232. Signal 235 is multiplied by signal 206 to provide signal 237 which is representative of ($F_{HI}$) ($C_{PH}$) ($T_{HI}$). Signal 237 is provided as a first input to the summing block 238 from the multiplying block 231.

Signals 63, 56 and 69, representative of the temperature, pressure and flow rate, respectively , of the steam flowing through conduit means 16 are provided to the block 241 and are used to calculate the volume flow rate of the steam flowing through conduit means 16 at standard conditions utilizing equation VI. Signal 242, representative of the volume flow rate of the steam flowing through conduit means 16 at standard conditions, it provided as a first input to the multiplying block 243. The multiplying block 243 is also provided with signal 245, which is representative of th density of the steam flowing through conduit means 16, as a second input. Signal 242 is multiplied by signal 245 to provide signal 246 which is representative of the mass flow rate of the steam flowing through conduit means 16 ($F_{SI}$). Signal 246 is provided as a first input to the multiplying block 247 from the multiplying block 243.

Signal 63, representative of the temperature of the steam flowing through conduit means 16 ($T_{SI}$), is also provided as a first input to the multiplying block 249. The multiplying block 249 is provided with a second input signal 251 which is representative of the specific heat of the steam flowing through conduit means 16 ($C_{PS}$). Signal 63 is multiplied by signal 251 to provide signal 252 which is representative of the enthalpy of the steam flowing through conduit means 16 ($C_{PS}$) ($T_{SI}$). Signal 252 is provided as a second input to the multiplying block 247 from the multiplying block 249. Signal 246 is multiplied by signal 252 to provide signal 253 which is representative of ($F_{SI}$) ($C_{PS}$) ($T_{SI}$). Signal 253 is provided as a second input to the summing block 238 from the multiplying block 247. Signal 237 is summed with signal 253 to provide signal 254 which is representative of the heat supplied to the cracking furnace by the feed gas and the steam ($H_{IN}$). Signal 254 is provided as a first input to the subtracting block 255 from the summing block 238.

Signal 39, which is representative of the volume flow rate of the feed stream flowing through conduit means 15 is provided as a first input to the bock 257. Signals 85 and 89 which are representative of the pressure and temperature respectively of the gaseous mixture flowing through conduit means 19 are also provided as inputs to the block 257. These inputs are utilized to calculate the volume flow rate of the portion of the gaseous mixture flowing through conduit means 19, contributed by the feed stream flowing through conduit means 15, at standard conditions. Signal 258, which is representative of the volume flow rate of the portion of the gaseous mixture flowing through conduit means 19, contributed by the feed stream flowing through conduit means 15, at standard conditions is provided as a first input to the multiplying block 259. The multiplying block 259 is provided with a second signal 211 which is representative of the density of the feed stream flowing through conduit means 15. Signal 211 is multiplied by signal 258 to provide signal 262 which is representative of the mass flow rate of the portion of the gaseous mixture flowing through conduit means 19 contributed by the hydrocarbon feed stream flowing through conduit means 15. Signal 262 is provided as a first input to the multiplying block 263 from the multiplying block 259.

Signal 89, which is representative of the temperature of the gaseous mixture flowing through conduit means 19 ($T_O$), is also provided as a first input to the multiplying block 264. The multiplying block 264 is provided with a second input signal 233 which is representative of the specific heat of the feed stream flowing through conduit means 15 ($C_{PH}$). Signal 89 is multiplied by signal 233 to provide signal 267 which is representative of ($C_{PH}$) ($T_O$). Signal 267 is provided as a second input to the multiplying block 263 from the multiplying block 264. Signal 262 is multiplied by signal 267 to provide signal 268 which is representative of ($F_{HO}$) ($C_{PH}$) ($T_O$). Signal 268 is provided as a first input to the summing block 269 from the multiplying block 263.

It is again noted that signal 39, representative of the volume flow rate of the feed stream flowing through conduit means 15, signal 211 representative of the density of the feed stream flowing through conduit means 15 and signal 233 representative of the specific heat of the feed stream flowing through conduit means 15 are utilized to calculate th heat which is removed from the cracking furnace of the portion of the gaseous mixture contributed by the feed stream flowing through conduit means 15. Even through these parameters are not actually measured for the gaseous mixture flowing through conduit means 19, these particular parameters will remain essentially unchanged even though the composition of the feed stream has been changed by the cracking process. This is also true for the portion of the gaseous mixture flowing through conduit means 19 which is contributed by the steam flowing through conduit means 16.

Signal 69, which is representative of the volume flow rate of the steam flowing through conduit means 16, is provided as an input to the block 271. Block 271 is also provided with signals 85 and 89 which are representative of the pressure and temperature, respectively, of the gaseous mixture flowing through conduit means 19. These input signals are utilized to calculate the volume flow rate of the portion of the gaseous mixture flowing through conduit means 19, which is contributed by the steam flowing through conduit means 16, at standard conditions. Signal 272, which is representative of the volume flow rate of the portion of the gaseous mixture flowing through conduit means 19, which is contributed by the steam flowing through conduit means 16, at standard conditions is provided as a first input to the multiplying block 273 from the block 271. The multiplying block 273 is also provided with a signal 245 which is representative of the density of the steam flowing through conduit means 16. Signal 272 is multiplied by signal 245 to provide signal 276 which is representative of the mass flow rate of the portion of the gaseous mixture flowing through conduit means 19 which is contributed by the steam flowing through conduit means 16, Signal 276 is provided as a first input to the multiplying block 277 from the multiplying block 273.

Signal 89, representative of the temperature of the gaseous mixture flowing through conduit means 19 ($T_O$), is provided as a first input to the multiplying block 278. The multiplying block 278 is also provided with a second input signal 251 which is representative of the specific heat of the steam flowing through conduit means 16 ($C_{PS}$). Signal 89 is multiplied by signal 251 to provide signal 281 which is representative of ($C_{PS}$) ($T_O$). Signal 281 is provided as a second input to the multiplying block 277. Signal 281 is multiplied by signal 276 to provide signal 282 which is representative of ($F_{SO}$) ($C_{PS}$) ($T_O$). Signal 282 is provided as a second input to the summing block 269 from the multiplying block 277.

Signal 282 is multiplied by signal 268 to provide signal 283 which is representative of the heat removed from the cracking furnace by the gaseous mixture flowing from the cracking furnace through conduit means 19 ($H_{OUT}$). Signal 283 is provided as a second input to the subtracting block 255. Signal 283 is subtracted from signal 254 to provide signal 284 which is representative of $H_{IN}$-$H_{OUT}$. Signal 284 is provided as a first input to the summing block 285 from the subtracting block 255.

Signal 206, which is representative of the mass flow rate of the hydrocarbon stream flowing through conduit means 19 is provided as a first input to the multiplying block 287. Signal 49 which is representative of the concentration of ethane in the feed stream flowing through conduit means 15 is provided as a second input to the multiplying block 287. Signal 206 is multiplied by signal 49 to provide signal 288 which is representative of ($F_{HI}$) ($C_E$). Signal 88 is provided as a first input to the multiplying block 289 from the multiplying block 287. The multiplying block 289 is provided with a second input signal 291 which is representative of the desired percentage conversion of ethane. Signal 288 is multiplied by signal 291 to provide signal 292 which is representative of ($F_{HI}$) ($C_E$) ($CONV_E$). Signal 292 is provided as a first input to the multiplying block 293. The multiplying block 293 is provided with a second input signal 294 which is representative of the heat of reaction for the conversion of ethane which is 2100 BTU/lb ($H_E$). Signal 292 is multiplied by signal 294 to provide signal 295 which is representative of the heat supplied to the cracking furnace by the conversion of ethane ($H_{CE}$). Signal 295 is provided as a first input to the summing block 296 from the multiplying block 293.

Signal 206, which is representative of the mass flow rate of the feed stream flowing through conduit means 19 is provided as a first input to the multiplying block 297. Signal 46, which is representative of the concentration of propane in the feed stream flowing through conduit means 19 is provided as a second input to the multiplying block 297. Signal 206 is multiplied by signal 46 to provide signal 298 which is representative of ($F_{HI}$) ($C_P$). Signal 298 is provided as a first input to the multiplying block 299 from the multiplying block 297. The multiplying block 299 is provided with a second input signal 301 which is representative of the desired percentage conversion of propane. Signal 301 is multiplied by signal 298 to provide signal 302 which is representative of ($F_{HI}$) ($C_P$) ($CONV_P$). Signal 302 is provided as a first input to the multiplying block 303. The multiplying block 303 is also provided with a second input signal 304 which is representative of the heat of reaction for the conversion of jpropane which is 1279 BTU/lb ($H_P$). Signal 304 is multiplied by signal 302 to provide signal 305 which is representative of the heat supplied to the cracking furnace by the conversion of propane ($H_{CP}$). Signal 305 is provided as a second input to the summing block 296.

Signal 295 and signal 305 are summed to provide signal 306 which is representative of $H_{CE}+H_{CP}$. Signal 306 is provided as a second input to the summing block 285. Signal 306 is summed with signal 284 to provide signal 308 which is representative of $H_{IN}-H_{OUT}+H_{CE}+H_{CP}$. Signal 308 is provided as a first input to the summing block 309 from the summing block 285.

Signal 75, which is representative of the concentration of ethane in the gaseous mixture flowing through conduit means 19, is provided as a first input to the subtracting block 311. Signal 49, which is representative of the concentration of ethane in the hydrocarbon feed stream flowing through conduit means 15, is provided as a second input to the subtracting block 311 and as a first input to the dividing block 312. Signal 75 is subtracted from signal 49 to provide signal 314. Signal 314 is provided to the dividing block 312 as a second input from the subtracting block 311. Signal 314 is divided by signal 301 to provide signal 315 which is representative of the measured percent conversion of ethane. Signal 315 is provided as a first input to the controller block 316 from the dividing block 312. The controller block 316 is also provided with a second input signal 291 which is representative of the desired percent conversion of ethane. The controller block 316 compares signals 315 and signal 291 and outputs signal 317 responsive to the difference between signals 291 and 315. Signal 317 is provided as a first input to the switching means 318.

Signal 78, which is representative of the concentration of propane in the gaseous mixture flowing through conduit means 19, is provided as a first input to the subtracting block 321. Signal 46, which is representative of the concentration of propane in the hydrocarbon feed stream flowing through conduit means 15, is provided as a second input to the subtracting block 321 and as a first input to the dividing block 322. Signal 78 is subtracted from signal 46 to provide signal 323. Signal 323 is provided as a second input to dividing block 322 from the subtracting block 321. Signal 323 is divided by signal 46 to provide signal 324 which is representative of the measured percent conversion of propane. Signal 324 is provided as a first input to the controller block 325 from the dividing block 322. The controller block 325 is also provided with a second input signal 301 which is representative of the desired percent conversion of propane. Signal 324 is compared to signal 301 by the controller block 325 which outputs the signal 326 responsive to the difference between signals 324 and 301. Signal 326 is provided as a second input to the switching means 318 from the controller block 325. Signals 317 and 326 are utilized to supply the heat loss term $H_L$ in equation (I). Comparison of the actual measured percent conversion and the desired percent conversion essentially provides feedback control for the cracking furnace illustrated in FIG. 1. Either the conversion of ethane or the conversion of propane can be utilized to supply the heat loss term by the use of switching means 318. Signal 327 which will be representative of the heat loss term ($H_L$) is provided as a second input to the summing block 309 from the switching means 318. Signal 327 is summed with signal 308 to provide signal 328 which is representative of the heat that must be supplied to the cracking furnace by the fuel flowing through conduit means 21 (Q). Signal 328 is provided as a first input to the dividing block 329 from the summing block 309. The dividing block 329 is provided with a second input signal 104 which is representative of the heating value of the fuel flowing through conduit means 21. Signal 328 is divided by signal 104 to provide signal 331 which is representative of the volumetric flow rate of the fuel flowing through conduit means 21 required to supply the heat required by the cracking furnace to maintain the desired percent conversion of ethane and propane. Signal 331 is provided as a first input to the dividing block 332. The dividing block 332 is provided with a second input signal 333 which is representative of the constant 2. The constant 2 is utilized because the fuel flowing through conduit means 21 is split into two flows through conduit means **21*a* and 21*b*. The split of the flows through conduit means 21*a* and 21*b* is assumed to be essentially equal, thus signal 331 is divided by 2 to provide signal 117 which is representative of the required volume flow rate of the fuel flowing through conduit means 21*a* and 21*b***.

In summary, the control system of the present invention provides a means by which disturbances in the streams flowing into the cracking furnace 11 may be compensated for before off-specification performance of the cracking furnace is detected by analysis of the gaseous mixture flowing through conduit means 19. This is accomplished by essentially predicting what change in the flow rate of the fuel flowing to the cracking furnace 11 will be required to compensate for any change in the flow rate of the feed stream or the flow rate of the steam flowing to the cracking furnace. This prediction is corrected as needed by a comparison of the measured percent conversion to the desired percent conversion. In this manner, off-specification performance of the cracking furnace 11 is minimized by the predictive feed forward control combined with the feedback control of comparing the measured percent conversion to the desired percent conversion. The control system also provides a means by which the cracking tubes 12a and 12b of the cracking furnace 11 are protected from a loss of flow by assuring that the steam flowing through conduit means 16 will provide a minimum flow to the cracking tubes 12a and 12b regardless of disturbances that may occur in the hydrocarbon feed stream flowing through conduit means 15.

The invention has been described in terms of a preferred embodiment as illustrated in FIGS. 1 and 2. Specific components which can be used in the practice of the invention as illustrated in FIGS. 1 and 2, such as flow sensors 36, 65, 92, 124 and 133; flow transducers 34, 64, 91, 123 and 132; pressure transducers 29, 51 and 81; temperature transducers 23, 58 and 86; flow controllers 109, 121 and 122; current-to-pressure transducers 128, 137 and 112; and pneumatic control valves 139, 131 and 115 are each well known, commercially available control components such as are illustrated and described at length in Perry's Chemical Engineers' Handbook, 4th Edition, Chapter 22, McGraw-Hill. A suitable analyzer 41, 71, and 101 is the Process Chromatograph System, Model 102, manufactured by Applied Automation Inc., Bartlesville, Okla.

A suitable A/D converter 48, 45, 38, 32, 26, 68, 61, 54, 94, 88, 84, 74, 76, and 103 is the MM 5357 8-bit A/D converter manufactured by National Semiconductor Corporation, Santa Clara. Calif. A suitable D/A converter 107 and 118 is the AD 559 8-bit D/A converter manufactured by Analog Devices, Norwood, Mass.

While the invention has been described in terms of the presently preferred embodiment, reasonable variations and modifications are possible by those skilled in the art, within the scope of the described invention and the appended claims.

That which is claimed is:

1. Apparatus comprising:

a cracking furnace means;

means for supplying a feed stream to said cracking furnace means;

means for supplying a diluent fluid to said cracking furnace means, said diluent fluid being combined with said feed stream;

means for supplying a fuel to said cracking furnace means, the combustion of said fuel supplying heat to said cracking furnace means;

means for removing a gaseous mixture, containing the cracked components of said feed stream and containing said diluent fluid, from said cracking furnace;

means for establishing a first signal representative of the heat supplied to said cracking furnace means by said feed stream and said diluent fluid;

means for establishing a second signal representative of the heat removed from said cracking furnace means by said gaseous mixture;

means for establishing a third signal representative of the heat supplied to said cracking furnace means by the cracking process when a desired percent of said feed stream is cracked;

means for establishing a fourth signal representative of any heat lost from said cracking furnace means other than that heat removed from said cracking furnace means by said gaseous mixture, said fourth signal including the difference, if any, between said third signal and the heat actually being supplied to said cracking furnace by the cracking process;

means for establishing a fifth signal in response to said first signal, said second signal, said third signal, and said fourth signal, said fifth signal being representative of the heat that must be supplied to said cracking furnace means to crack a desired percent of said feed stream;

means for establishing a sixth signal representative of the heating value of said fuel;

means for establishing a seventh signal in response to said fifth signal and said sixth signal, said seventh signal being representative of the flow rate of said fuel required to supply the heat required by said cracking furnace to crack a desired percent of said feed stream;

means for establishing an eighth signal representative of the actual flow rate of said fuel;

means for comparing said seventh signal and said eighth signal and for establishing a ninth signal responsive to the difference between said seventh signal and said eighth signal; and means for manipulating the flow rate of said fuel in response to said ninth signal.

2. Apparatus in accordance with claim 1 wherein said diluent fluid is steam and said feed stream is natural gas.

3. Apparatus in accordance with claim 2 wherein said means for establishing said first signal comprises:

means for establishing a tenth signal representative of the mass flow rate of said feed stream ($F_{HI}$);

means for establishing an eleventh signal representative of the specific heat of said feed stream ($C_{PH}$);

means for multiplying said tenth signal by said eleventh signal to establish a twelfth signal representative of ($F_{HI}$) ($C_{PH}$);

means for establishing a thirteenth signal representative of the temperature of said feed stream ($T_{HI}$);

means for multiplying said twelfth signal by said thirteenth signal to establish a fourteenth signal representative of ($F_{HI}$) ($C_{PH}$) ($T_{HI}$);

means for establishing a fifteenth signal representative of the mass flow rate of said steam $F_{SI}$;

means for establishing a sixteenth signal representative of the specific heat of said steam $C_{PS}$;

means for multiplying said fifteenth signal by said sixteenth signal to establish a seventeenth signal representative of ($F_{SI}$) ($C_{PS}$);

means for establishing an eighteenth signal representative of the temperature of said steam ($T_{SI}$);

means for multiplying said seventeenth signal by said eighteenth signal to establish a nineteenth signal representative of ($F_{SI}$) ($C_{PS}$) ($T_{SI}$); and means for adding said fourteenth signal and said nineteenth signal to establish said first signal.

4. Apparatus in accordance with claim 3 wherein said means for establishing said tenth signal comprises:

means for establishing a twentieth signal representative of the volume flow rate of said feed stream;

means for establishing a twenty-first signal representative of the pressure of said feed stream;

means for establishing a twenty-second signal, representative of the volume flow rate of said feed stream at standard conditions, in response to said twentieth signal, said twenty-first signal and said thirteenth signal;

means for establishing a twenty-third signal representative of the density of said feed stream; and means for multiplying said twenty-second signal by said twenty-third signal to establish said tenth signal.

5. Apparatus in accordance with claim 3 wherein said means for establishing said fifteenth signal comprises:

means for establishing a twentieth signal representative of the volume flow rate of said steam;

means for establishing a twenty-first signal representative of the pressure of said steam;

means for establishing a twenty-second signal, representative of the volume flow rate of said steam at standard conditions, in response to said twentieth signal, said twenty-first signal and said eighteenth signal;

means for establishing a twenty-third signal representative of the density of said steam; and means for multiplying said twenty-second signal by said twenty-third signal to establish said fifteenth signal.

6. Apparatus in accordance with claim 2 wherein said means for establishing said second signal comprises:

means for establishing a tenth signal representative of the mass flow rate of the portion of said gaseous mixture which is contributed by said feed stream ($F_{HO}$);

means for establishing an eleventh signal representative of the specific heat of said feed stream ($C_{PH}$);

means for multiplying said tenth signal by said eleventh signal to establish a twelfth signal representative of ($F_{HO}$) ($C_{PH}$);

means for establishing a thirteenth signal representative of the temperature of said gaseous mixture ($T_O$);

means for multiplying said twelfth signal by said thirteenth signal to establish a fourteenth signal representative of ($F_{HO}$) ($C_{PH}$) ($T_O$);

means for establishing a fifteenth signal representative of the mass flow rate of the portion of said gaseous mixture which is contributed by said steam ($F_{SD}$);

means for establishing a sixteenth signal representative of the specific heat of said steam ($C_{PS}$);

means for multiplying said fifteenth signal by said sixteenth signal to establish a seventeenth signal representative of ($F_{SO}$) ($C_{PS}$);

means for multiplying said seventeenth signal by said thirteenth signal to establish an eighteenth signal representative of ($F_{SO}$) ($C_{PS}$) ($T_O$); and means for adding said fourteenth signal and said eighteenth signal to establish said second signal.

7. Apparatus in accordance with claim 6 wherein said means for establishing said tenth signal comprises:

means for establishing a nineteenth signal representative of the volume flow rate of said feed stream;

means for establishing a twentieth signal representative of the pressure of said gaseous mixture;

means for establishing a twenty-first signal representative of the volume flow rate of the portion of said gaseous mixture, which is contributed by said feed stream, at standard conditions in response to said nineteenth signal, said twentieth signal and said thirteenth signal;

means for establishing a twenty-second signal representative of the density of said feed stream; and means for multiplying said twenty-first signal by said twenty-second signal to establish said tenth signal.

8. Apparatus in accordance with claim 6 wherein said means for establishing said fifteenth signal comprises:

means for establishing a nineteenth signal representative of the volume flow rate of said steam;

means for establishing a twentieth signal representative of the pressure of said gaseous mixture;

means for establishing a twenty-first signal representative of the volume flow rate of the portion of said gaseous mixture, which is contributed by said steam, at standard conditions in response to said nineteenth signal, said twentieth signal and said thirteenth signal;

means for establishing a twenty-second signal representative of the density of said steam; and means for multiplying said twenty-first signal by said twenty-second signal to establish said fifteenth signal.

9. Apparatus in accordance with claim 1 wherein said means for establishing said third signal comprises:

means for establishing a tenth signal representative of the mass flow rate of said feed stream ($F_{HI}$);

means for establishing an eleventh signal which is representative of the concentration of the primary constituent of said feed stream which is to be cracked ($C_1$);

means for multiplying said tenth signal by said eleventh signal to establish a twelfth signal representative of ($F_{HI}$) ($C_1$);

means for establishing a thirteenth signal representative of the desired percent conversion of said primary constituent of said feed stream which is to be cracked ($CONV_1$);

means for multiplying said twelfth signal by said thirteenth signal to establish a fourteenth signal representative of ($F_{HI}$) ($C_1$) ($CONV_1$);

means for establishing a fifteenth signal representative of the heat of reaction for the conversion of said primary constituent of said feed stream which is to be cracked ($H_1$);

means for multiplying said fourteenth signal by said fifteenth signal to establish a sixteenth signal representative of ($F_{HI}$) ($C_1$) ($CONV_1$) ($H_1$);

means for establishing a seventeenth signal which is representative of the concentration of a secondary constituent of said feed stream which is to be cracked ($C_2$);

means for multiplying said tenth signal by said seventeenth signal to establish an eighteenth signal representative of ($F_{HI}$) ($C_2$);

means for establishing a nineteenth signal representative of the desired percent conversion of said secondary constituent of said feed stream which is be cracked ($CONV_2$);

means for multiplying said eighteenth signal by said nineteenth signal to establish a twentieth signal representative of ($F_{HI}$) ($C_2$) ($CONV_2$);

means for establishing a twenty-first signal representative of the heat of reaction for the conversion of said secondary constituent of said feed stream which is to be cracked ($H_2$);

means for multiplying said twentieth signal by said twenty-first signal to establish a twenty-second signal representative of ($F_{HI}$) ($C_2$) ($CONV_2$) ($H_2$); and means for adding said sixteenth signal and said twenty-seond signal to establish said third signal.

10. Apparatus in accordance with claim 9 wherein said means for establishing said tenth signal comprises:

means for establishing a twenty-third signal representative of the volume flow rate of said feed stream;

means for establishing a twenty-fourth signal representative of the pressure of said feed stream;

means for establishing a twenty-fifth signal representative of the temperature of said feed stream;

means for establishing a twenty-sixth signal representative of the volume flow rate of said feed stream at standard conditions in response to said twenty-third signal, said twenty-fourth signal and said twenty-fifth signal;

means for establishing a twenty-seventh signal representative of the density of said feed stream; and means for multiplying said twenty-sixth signal by said twenty-seventh signal to establish said tenth signal.

11. Apparatus in accordance with claim 1 wherein said means for establishing said fourth signal comprises:

means for establishing a tenth signal representative of the concentration of a constituent of said feed stream which is to be cracked (C);

means for establishing an eleventh signal representative of the concentration of said constituent of said feed stream which is to be cracked, in said gaseous mixture;

means for establishing a twelfth signal in response to said tenth signal and said eleventh signal, said twelfth signal being representative of the percent conversion of said constituent of said feed stream which is to be cracked;

means for establishing a thirteenth signal representative of the desired percent conversion of said constituent of said feed stream which is to be cracked; and means for comparing said twelfth signal and said thirteenth signal and for establishing said fourth signal responsive to the difference between said twelfth signal and said thirteenth signal.

12. Apparatus in accordance with claim 1 wherein said means for establishing said fifth signal comprises means for summing said first signal, said third signal and said fourth signal and for subtracting said second signal from the sum of said first signal, said third signal and said fourth signal.

13. Apparatus in accordance with claim 1 wherein said means for establishing said seventh signal comprises means for dividing said fifth signal by said sixth signal to establish said seventh signal.

14. Apparatus in accordance with claim 1 additionally comprising:

means for establishing a tenth signal representative of the flow rate of said diluent fluid required to maintain a desired ratio of said diluent fluid to said feed stream;

means for establishing an eleventh signal representative of the flow rate of said diluent fluid required to maintain a desired total flow to said cracking furnace means to prevent damage to said cracking furnace means; and means for controlling the flow rate of said diluent fluid in response to the higher of said tenth and said eleventh signals.

15. Apparatus in accordance with claim 14 wherein said means for establishing said tenth signal comprises:

means for establishing a twelfth signal representative of the mass flow rate of said feed stream;

means for establishing a thirteenth signal representative of the desired ratio of said diluent fluid to said feed stream; and means for multiplying said twelfth signal by said thirteenth signal to establish said tenth signal.

16. Apparatus in accordance with claim 15 wherein said means for establishing said eleventh signal comprises:

means for establishing a fourteenth signal representative of the minimum allowable total flow rate to said cracking furnace means; and means for subtracting said twelfth signal from said fourteenth signal to establish said eleventh signal.

17. Apparatus in accordance with claim 16 wherein said means for establishing said twelfth signal comprises:

means for establishing a fifteenth signal representative of the volume flow rate of said feed stream;

means for establishing a sixteenth signal representative of the pressure of said feed stream;

means for establishing a seventeenth signal representative of the temperature of said feed stream;

means for establishing an eighteenth signal representative of the volume flow rate of said feed stream at standard conditions in response to said fifteenth signal, said sixteenth signal and said seventeenth signal;

means for establishing a nineteenth signal representative of the density of said feed stream; and means for multiplying said eighteenth signal by said nineteenth signal to establish said twelfth signal.

18. Apparatus in accordance with claim 14 wherein said means for controlling the flow rate of said diluent fluid in response to the higher of said tenth signal and said eleventh signal comprises:

a high select means for selecting the higher of said tenth and said eleventh signals and for establishing a twelfth signal representative of the higher of said tenth and said eleventh signals;

means for establishing a thirteenth signal representative of the density of said diluent fluid;

means for dividing said twelfth signal by said thirteenth signal to produce a fourteenth signal representative of the required volume flow rate of said diluent fluid at standard conditions;

means for establishing a fifteenth signal representative of the temperature of said diluent fluid;

means for establishing a sixteenth signal representative of the pressure of said diluent fluid;

means for establishing a seventeenth signal in response to said fourteenth signal, said fifteenth signal and said sixteenth signal, said seventeenth signal being representative of the required volume flow rate of said diluent fluid at the temperature and pressure of said diluent fluid;

means for establishing an eighteenth signal representative of the flow rate of said diluent fluid;

means for comparing said seventeenth signal and said eighteenth signal and for establishing a nineteenth signal responsive to the difference between said seventeenth signal and said eighteenth signal; and means for manipulating the flow rate of said diluent fluid in response to said nineteenth signal.

19. A method for operating a cracking furnace comprising the steps of:

combining a feed stream provided to said cracking furnace with a diluent fluid;

supplying fuel to said cracking furnace, the combustion of said fuel supplying heat to said cracking furnace;

removing a gaseous mixture, containing the cracked components of said feed stream and containing said diluent fluid, from said cracking furnace;

establishing a first signal representative of a prediction of the heat required by said cracking furnace to maintain a desired percent conversion;

establishing a second signal representative of said desired percent conversion;

establishing a third signal representative of the actual percent conversion;

comparing said second signal and said third signal and establishing a fourth signal responsive to the difference between said second signal and said third signal;

combining said first signal and said fourth signal to establish a fifth signal representative of a corrected prediction of the heat required by said cracking furnace to maintain said desired percent conversion;

establishing a sixth signal representative of the heating value of said fuel;

establishing a seventh signal in response to said fifth signal and said sixth signal, said seventh signal being representative of the flow rate of said fuel required to supply the heat required by said cracking furnace to maintain said desired percent conversion;

establishing an eighth signal representative of the actual flow rate of said fuel;

comparing said seventh signal and said eighth signal and establishing a ninth signal responsive to the difference between said seventh signal and said eighth signal; and manipulating the flow rate of said fuel in response to said ninth signal.

20. A method in accordance with claim 19 wherein said step of establishing said first signal comprises:

establishing a tenth signal representative of the heat supplied to said cracking furnace by said feed stream and said diluent fluid;

establishing an eleventh signal representative of the heat removed from said cracking furnace by said gaseous mixture;

establishing a twelfth signal representative of the heat supplied to said cracking furnace by the cracking process when a desired percent of said feed stream is cracked; and establishing said first signal in response to said tenth signal, said eleventh signal and said twelfth signal.

21. A method in accordance with claim 20 wherein said step of establishing said first signal in response to said tenth signal, said eleventh signal and said twelfth signal comprises summing said tenth signal and said twelfth signal and subtracting said eleventh signal from the sum of said tenth signal and said twelfth signal.

22. A method in accordance with claim 21 wherein said diluent fluid is steam and said feed stream is natural gas.

23. A method in accordance with claim 22 wherein said step of establishing said tenth signal comprises:

establishing a thirteenth signal representative of the mass flow rate of said feed stream ($F_{HI}$);

establishing a fourteenth signal representative of the specific heat of said feed stream ($C_{PH}$);

multiplying said thirteenth signal by said fourteenth signal to establish a fifteenth signal representative of ($F_{HI}$) ($C_{PH}$);

establishing a sixteenth signal representative of the temperature of said feed stream ($T_{HI}$);

multiplying said fifteenth signal by said sixteenth signal to establish a seventeenth signal representative of ($F_{HI}$) ($C_{PH}$) ($T_{HI}$);

establishing an eighteenth signal representative of the mass flow rate of said steam ($F_{SI}$);

establishing a nineteenth signal representative of the specific heat of said steam ($C_{PS}$);

multiplying said eighteenth signal by said nineteenth signal to establish a twentieth signal representative of ($F_{SI}$) ($C_{PS}$);

establishing a twenty-first signal representative of the temperature of said steam ($T_{SI}$);

multiplying said twentieth signal by said twenty-first signal to establish a twenty-second signal representative of ($F_{SI}$) ($C_{PS}$) ($T_{SI}$); and adding said seventeenth signal and said twenty-second signal to establish said tenth signal.

24. A method in accordance with claim 23 wherein said step of establishing said thirteenth signal comprises:

establishing a twenty-third signal representative of the volume flow rate of said feed stream;

establishing a twenty-fourth signal representative of the pressure of said feed stream;

establishing a twenty-fifth signal representative of the volume flow rate of said feed stream at standard conditions in response to said twenty-third signal, said twenty-fourth signal and said sixteenth signal;

establishing a twenty-sixth signal representative of the density of said feed stream; and multiplying said twenty-fifth signal by said twenty-sixth signal to establish said thirteenth signal.

25. A method in accordance with claim 23 wherein said step of establishing said eighteenth signal comprises:

establishing a twenty-third signal representative of the volume flow rate of said steam;

establishing a twenty-fourth signal representative of the pressure of said steam;

establishing a twenty-fifth signal representative of the volume flow rate of said steam at standard conditions in response to said twenty-third signal, said twenty-fourth signal and said twenty-first signal;

establishing a twenty-sixth signal representative of the density of said steam; and multiplying said twenty-fifth signal by said twenty-sixth signal to establish said eighteenth signal.

26. A method in accordance with claim 20 wherein said step of establishing said eleventh signal comprises:

establishing a thirteenth signal representative of the mass flow rate of the portion of said gaseous mixture which is contributed by said feed stream ($F_{HO}$);

establishing a fourteenth signal representative of the specific heat of said feed stream ($C_{PH}$);

multiplying said thirteenth signal by said fourteenth signal to establish a fifteenth signal representative of ($F_{HO}$) ($C_{PH}$);

establishing a sixteenth signal representative of the temperature of said gaseous mixture ($T_O$);

multiplying said fifteenth signal by said sixteenth signal to establish a seventeenth signal representative of ($F_{HO}$) ($C_{PH}$) ($T_O$);

establishing an eighteenth signal representative of the mass flow rate of the portion of said gaseous mixture which is contributed by said steam ($F_{SO}$);

establishing a nineteenth signal representative of the specific heat of said steam ($C_{PS}$);

multiplying said eighteenth signal by said nineteenth signal to establish a twentieth signal representative of ($F_{SO}$) ($C_{PS}$);

multiplying said twentieth signal by said sixteenth signal to establish a twenty-first signal representative of ($F_{SO}$) ($C_{PS}$) ($T_O$); and adding said seventeenth signal and said twenty-first signal to establish said eleventh signal.

27. A method in accordance with claim 26 wherein said step of establishing said thirteenth signal comprises:

establishing a twenty-second signal representative of the volume flow rate of said feed stream;

establishing a twenty-third signal representative of the pressure of said gaseous mixture;

establishing a twenty-fourth signal representative of the volume flow rate of the portion of said gaseous mixture, which is contributed by said feed stream, at standard conditions in response to said twenty-second signal, said twenty-third signal and said sixteenth signal;

establishing a twenty-fifth signal representative of the density of said feed stream; and multiplying said twenty-fourth signal by said twenty-fifth signal to establish said thirteenth signal.

28. A method in accordance with claim 26 wherein said step of establishing said eighteenth signal comprises:

establishing a twenty-second signal representative of the volume flow rate of said steam;

establishing a twenty-third signal representative of the pressure of said gaseous mixture;

establishing a twenty-fourth signal representative of the volume flow rate of the portion of said gaseous mixture, which is contributed by said steam, at standard conditions in response to said twenty-second signal, said twenty-third signal and said sixteenth signal;

establishing a twenty-fifth signal representative of the density of said steam; and multiplying said twenty-fourth signal by said twenty-fifth signal to establish said eighteenth signal.

29. A method in accordance with claim 22 wherein said step of establishing said twelfth signal comprises:

establishing a thirteenth signal representative of the mass flow rate of said feed stream ($F_{HI}$);

establishing a fourteenth signal which is representative of the concentration of the primary constituent of said feed stream which is to be cracked ($C_1$);

multiplying said thirteenth signal by said fourteenth signal to establish a fifteenth signal representative of ($F_{HI}$) ($C_1$);

establishing a sixteenth signal representative of the desired percent conversion of said primary constituent of said feed stream which is to be cracked ($CONV_1$);

multiplying said fifteenth signal by said sixteenth signal to establish a seventeenth signal representative of ($F_{HI}$) ($C_1$) ($CONV_1$);

establishing an eighteenth signal representative of the heat of reaction for the conversion of the primary constituent of said feed stream which is to be cracked ($H_1$);

multiplying said seventeenth signal by said eighteenth signal to establish a nineteenth signal representative of ($F_{HI}$) ($C_1$) ($CONV_1$) ($H_1$);

establishing a twentieth signal which is representative of the concentration of a secondary constituent of said feed stream which is to be cracked ($C_2$);

multiplying said thirteenth signal by said twentieth signal to establish a twenty-first signal representative of ($F_{HI}$) ($C_2$);

establishing a twenty-second signal representative of the desired percent conversion of said secondary constituent of said feed stream which is to be cracked ($CONV_2$);

multiplying said twenty-first signal by said twenty-second signal to establish a twenty-third signal representative of ($F_{HI}$) ($C_2$) ($CONV_2$);

establishing a twenty-fourth signal representative of the heat of reaction for the conversion of the secondary constituent of said feed stream which is to be cracked ($H_2$);

multiplying said twenty-third signal by said twenty-fourth signal to establish a twenty-fifth representative of ($F_{HI}$) ($C_2$) ($CONV_2$) ($H_2$); and summing said nineteenth signal and said twenty-fifth signal to establish said twelfth signal.

30. A method in accordance with claim 29 wherein said step of establishing said thirteenth signal comprises:

establishing a twenty-sixth signal representative of the volume flow rate of said feed stream;

establishing a twenty-seventh signal representative of the pressure of said feed stream;

establishing a twenty-eighth signal representative of the temperature of said feed stream;

establishing a twenty-ninth signal representative of the volume flow rate of said feed stream at standard conditions in response to said twenty-sixth signal, said twenty-seventh signal and said twenty-eighth signal;

establishing a thirtieth signal representative of the density of said feed stream; and multiplying said twenty-ninth signal by said thirtieth signal to establish said thirteenth signal.

31. A method in accordance with claim 19 wherein said step of combining said first signal and said fourth signal comprises summing said first signal and said fourth signal.

32. A method in accordance with claim 19 wherein said step of establishing said seventh signal in response to said fifth signal and said sixth signal comprises dividing said fifth signal by said sixth signal.

33. A method in accordance with claim 19 additionally comprising the steps of:

establishing a tenth signal representative of the flow rate of said diluent fluid required to maintain a desired ratio of said diluent fluid to said feed stream;

establishing an eleventh signal representative of the flow rate of said diluent fluid required to maintain a desired total flow to said cracking furnace means to prevent damage to said cracking furnace means; and controlling the flow rate of said diluent fluid in response to the higher of said tenth and said eleventh signals.

34. A method in accordance with claim 33 wherein said step of establishing said tenth signal comprises:

establishing a twelfth signal representative of the mass flow rate of said feed stream;

establishing a thirteenth signal representative of the desired ratio of said diluent fluid to said feed stream; and multiplying said twelfth signal by said thirteenth signal to establish said tenth signal.

35. A method in accordance with claim 34 wherein said step of establishing said eleventh signal comprises:

establishing a fourteenth signal representative of the minimum allowable total flow rate to said cracking furnace;

substracting said twelfth signal from said fourteenth signal to establish said eleventh signal.

36. A method in accordance with claim 35 wherein said step of establishing said twelfth signal comprises:

establishing a fifteenth signal representative of the volume flow rate of said feed stream;

establishing a sixteenth signal representative of the pressure of said feed stream;

establishing a seventeenth signal representative of the temperature of said feed stream;

establishing an eighteenth signal representative of the volume flow rate of said feed stream at standard conditions in response to said fifteenth signal, said sixteenth signal and said seventeenth signal;

establishing a nineteenth signal representative of the density of said feed stream; and multiplying said eighteenth signal by said nineteenth signal to establish said twelfth signal.

37. A method in accordance with claim 33 wherein said step of controlling the flow rate of said diluent fluid in response to the higher of said tenth signal and said eleventh signal comprises:

selecting the higher of said tenth signals and said eleventh signal and establishing a twelfth signal representative of the higher of said tenth signal or said eleventh signal;

establishing a thirteenth signal representative of the density of said diluent fluid;

dividing said twelfth signal by said thirteenth signal to produce a fourteenth signal representative of the required volume flow rate of said diluent fluid at standard conditions;

establishing a fifteenth signal representative of the temperature of said diluent fluid;

establishing a sixteenth signal representative of the pressure of said diluent fluid;

establishing a seventeenth signal in response to said fourteenth signal, said fifteenth signal and said sixteenth signal, said seventeenth signal being representative of the required volume flow rate of said diluent fluid at the temperature and pressure of said diluent fluid;

establishing an eighteenth signal representative of the actual flow rate of said diluent fluid;

comparing said seventeenth signal and said eighteenth signal and establishing a nineteenth signal responsive to the difference between said seventeenth signal and said eighteenth signal; and manipulating the flow rate of said diluent fluid in response to said nineteenth signal.

38. Apparatus comprising:

a cracking furnace means;

means for supplying a feed stream to said cracking furnace means;

means for supplying a diluent fluid to said cracking furnace means, said diluent fluid being combined with said feed stream;

means for supplying a fuel to said cracking furnace means, the combustion of said fuel supplying heat to said cracking furnace means;

means for removing a gaseous mixture, containing the cracked components of said feed stream and containing said diluent fluid, from said cracking furnace means;

means for establishing a first signal representative of the flow rate of said diluent fluid required to maintain a desired ratio of said diluent fluid to said feed stream;

means for establishing a second signal representative of the flow rate of said diluent fluid required to maintain a desired total flow to said cracking furnace means to prevent damage to said cracking furnace means; and means for controlling the flow rate of said diluent fluid in response to the higher of said first and said second signals.

39. Apparatus in accordance with claim 38 wherein said means for establishing said first signal comprises:

means for establishing a third signal representative of the mass flow rate of said feed stream;

means for establishing a fourth signal representative of the desired ratio of said diluent fluid to said feed stream; and means for multiplying said third signal by said fourth signal to establish said first signal.

40. Apparatus in accordance with claim 39 wherein said means for establishing said second signal comprises:

means for establishing a fifth signal representative of the minimum allowable total flow rate to said cracking furnace; and means for subtracting said third signal from said fifth signal to establish said second signal.

41. Apparatus in accordance with claim 39 wherein said means for establishing said third signal comprises:

means for establishing a fifth signal representative of the volume flow rate of said feed stream;

means for establishing a sixth representative of the pressure of said feed stream;

means for establishing a seventh signal representative of the temperature of said feed stream;

means for establishing an eighth signal representative of the volume flow rate of said feed stream at standard conditions in response to said fifth signal, said sixth signal and said seventh signal;

means for establishing a ninth signal representative of the density of said feed stream; and means for multiplying said eighth signal by said ninth signal to establish said third signal.

42. Apparatus in accordance with claim 38 wherein said means for controlling the flow rate of said diluent fluid in response to the higher of said first and said second signals comprises:

a high select means for selecting the higher of said first and said second signals and for establishing a third signal representative of the higher of said first and said second signals;

means for establishing a fourth signal representative of the density of said diluent fluid;

means for dividing said third signal by said fourth signal to produce a fifth signal representative of the required volume flow rate of said diluent fluid at standard conditions;

means for establishing a sixth signal representative of the temperature of said diluent fluid;

means for establishing a seventh signal representative of the pressure of said diluent fluid;

means for establishing an eighth signal in response to said fifth signal, said sixth signal and said seventh signal, said eighth signal being representative of the required volume flow rate of said diluent fluid at the temperature and pressure of said diluent fluid;

means for establishing a ninth signal representative of the actual flow rate of said diluent fluid;

means for comparing said eighth signal and said ninth signal and for establishing a tenth signal responsive to the difference between said eighth signal and said ninth signal; and

43. A method for controlling the flow rate of a diluent fluid which is combined with a feed stream before said feed stream is cracked in a cracking furnace comprising the steps of:

establishing a first signal representative of the flow rate of said diluent fluid required to maintain a desired ratio of said diluent fluid to said feed;

establishing a second signal representative of the flow rate of said diluent fluid required to maintain a desired total flow to said cracking furnace to prevent damage to said cracking furnace; and controlling the flow rate of said diluent fluid in response to the higher of said first and said second signals.

44. A method in accordance with claim 43 wherein said step of establishing said first signal comprises:

establishing a third signal representative of the mass flow rate of said feed stream;

establishing a fourth signal representative of the desired ratio of said diluent fluid to said feed stream; and multiplying said third signal by said fourth signal to establish said first signal.

45. A method in accordance with claim 44 wherein said step of establishing said second signal comprises:

establishing a fifth signal representative of the minimum allowable total flow rate to said cracking furnace;

subtracting said third signal from said fifth signal to establish said second signal.

46. A method in accordance with claim 44 wherein said step of establishing said third signal comprises:

establishing a fifth signal representative of the volume flow rate of said feed stream;

establishing a sixth signal representative of the pressure of said feed stream;

establishing a seventh signal representative of the temperature of said feed stream;

establishing an eighth signal representative of the volume flow rate of said feed stream at standard conditions in response to said fifth signal, said sixth signal and said seventh signal;

establishing a ninth signal representative of the density of said feed steam; and multiplying said eighth signal by said ninth signal to establish said third signal.

47. A method in accordance with claim 43 wherein said step of controlling the flow rate of said diluent fluid in response to the higher of said first signal and said second signal comprises:

selecting the higher of said second and said first signals and establishing a third signal representative of the higher of said first and said second signals;

establishing a fourth signal representative of the density of said diluent fluid;

dividing said third signal by said fourth signal to produce a fifth signal representative of the required volume flow rate of said diluent fluid;

establishing a sixth signal representative of the temperature of said diluent fluid;

establishing a seventh signal representative of the pressure of said diluent fluid;

establishing an eighth signal in response to said fifth signal, said sixth signal and said seventh signal, said eighth signal being representative of the required volume flow rate of said diluent fluid at the temperature and pressure of said diluent fluid;

establishing a ninth signal representative of the actual flow rate of said diluent fluid;

comparing said eighth signal and said ninth signal and establishing a tenth signal responsive to the difference between said eighth signal and said ninth signal; and manipulating the flow rate of said diluent fluid in response to said tenth signal.

* * * * *

UNITED STATES PATENT AND TRADEMARK OFFICE

CERTIFICATE OF CORRECTION

PATENT NO. : U.S. 4,231,753

DATED : November 4, 1980

INVENTOR(S) : William S. Stewart

It is certified that error appears in the above-identified patent and that said Letters Patent are hereby corrected as shown below:

Column 26, claim 41, line 30, after "sixth", insert --- signal ---.

Column 27, claim 42, line 2, after "and", insert new paragraph

--- means for manipulating the flow rate of said diluent fluid in response to said tenth signal. ---

Column 28, claim 46, line 8, after "feed", delete "steam" and insert --- stream ---.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*